US006478014B1

(12) United States Patent
Kohlhaas

(10) Patent No.: US 6,478,014 B1
(45) Date of Patent: Nov. 12, 2002

(54) DELIVERY UNIT ARRANGED IN A SURGE CHAMBER OF A FUEL TANK OF A MOTOR VEHICLE

(75) Inventor: Helmut Kohlhaas, Wildeck (DE)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

(21) Appl. No.: 09/718,678

(22) Filed: Nov. 22, 2000

(30) Foreign Application Priority Data

Nov. 23, 1999 (DE) ..... 199 56 141
Nov. 8, 2000 (DE) ..... 100 55 344

(51) Int. Cl.[7] ..... F02M 37/04
(52) U.S. Cl. ..... 123/509; 123/514; 417/363
(58) Field of Search ..... 123/509, 514, 123/510; 417/79, 80, 81, 83, 360, 363, 364; 137/549

(56) References Cited

U.S. PATENT DOCUMENTS

| | | | | |
|---|---|---|---|---|
| 4,886,031 A | | 12/1989 | Scheurenbrand et al. | |
| 4,946,351 A | * | 8/1990 | Richardson, Jr. | 417/363 |
| 5,392,750 A | * | 2/1995 | Laue et al. | 123/509 |
| 5,452,701 A | * | 9/1995 | Tuckey | 123/509 |
| 5,564,397 A | | 10/1996 | Kleppner et al. | |
| 5,699,773 A | * | 12/1997 | Kleppner et al. | 123/510 |
| 5,875,816 A | * | 3/1999 | Frank et al. | 137/549 |
| 6,155,793 A | * | 12/2000 | Tuckey et al. | 417/87 |
| 6,231,318 B1 | * | 5/2001 | Cotton et al. | 417/423.1 |

FOREIGN PATENT DOCUMENTS

| | | | |
|---|---|---|---|
| DE | 32 25 929 | 1/1984 | F02M/37/00 |
| DE | 37 19 809 | 6/1988 | B60K/15/02 |
| DE | 91 16 296.3 | 9/1992 | F02M/37/20 |
| DE | 43 36 574 | 5/1995 | F02M/37/10 |
| DE | 297 00 031 | 6/1998 | F02M/37/08 |
| EP | 0 378 796 | 7/1990 | B60K/15/00 |
| EP | 0 562 536 | 9/1993 | F02M/37/10 |
| EP | 0 694 691 | 1/1996 | F02M/37/02 |
| EP | 0 959 242 | 11/1999 | F02M/37/10 |
| GB | 2 054 755 | 2/1981 | F04B/21/00 |
| WO | WO 88/01346 | 2/1988 | F02M/37/00 |

* cited by examiner

*Primary Examiner*—Carl S. Miller
(74) *Attorney, Agent, or Firm*—Cohen, Pontani, Lieberman & Pavane

(57) ABSTRACT

A delivery unit arranged in a surge chamber of a fuel tank includes an ejector for filling the surge tank. One half of the ejector is defined by the surge chamber and the other half is defined by a pump holder holding a fuel pump in the surge chamber. The pump holder and the surge chamber are configured as components which are easy to manufacture, thereby allowing the delivery unit to be cost-effectively configured.

8 Claims, 3 Drawing Sheets

DELIVERY UNIT ARRANGED IN A SURGE CHAMBER OF A FUEL TANK OF A MOTOR VEHICLE

BACKGROUND OF THE INVENTION

1. Field of the Invention

The present invention relates to a delivery unit arranged in a surge chamber of a fuel tank of a motor vehicle having a fuel pump for delivering fuel to an internal combustion engine of the motor vehicle, an ejector connected to the fuel pump for the delivery of fuel from the fuel tank to the surge chamber, and a pump holder for holding the fuel pump in the surge chamber.

2. Description of the Related Art

Delivery units having fuel pumps, ejectors, and pump holders are frequently employed in present-day motor vehicles and are known from practice. The pump holder of the known delivery unit has a two-part configuration, a sealing ring inserted in an opening arranged in the floor region of the surge chamber, and an arm fastened to a cap of the surge chamber. The fuel pump is preloaded against the sealing ring by the arm. The ejector is supplied with fuel by the fuel pump and induces the fuel from the fuel tank through an opening. The ejector is integrated in a housing of the fuel pump.

The known fuel pump and ejector combination represents a component of very complex design. In addition, the ejector makes maintenance work on the fuel pump more difficult.

SUMMARY OF THE INVENTION

An object of the present invention is to provide a delivery unit for insertion in a surge chamber of a motor vehicle fuel tank that has a simplified assembly and fitting.

The object is met according to the present invention by configuring the ejector as a structural unit with the pump holder and/or the surge chamber.

The inventive configuration allows the fuel pump to be simply fitted in and removed from the surge chamber separately from the ejector. According to the present invention, maintenance work on the fuel pump is not hindered by the ejector and is therefore very simple. Furthermore, the inventive configuration allows the fuel pump to have a simple construction and accordingly, may be manufactured at favorable cost. A further advantage of the present invention is that the materials are separated into their correct types during the removal of the delivery unit according to the invention because the pump holder, like the ejector and the surge chamber, is generally manufactured from plastic and the fuel pump usually exhibits a housing cap and a housing cover made of metal.

The fitting of the delivery unit according to the present invention may comprise a snap-in connection to connect the fuel pump to the pump holder which is fastened onto the floor of the surge chamber. The snap-in connection obviates the need to preload the fuel pump by an arm supported on the cap of the surge chamber.

The fuel pump is reliably held in its specified position if the pump holder exhibits a peripheral rim surrounding a lower region of the fuel pump and the snap-in connection exhibits a protrusion which extends radially inward proximate the free end of the rim.

The fitting and removal of the delivery unit according to the present invention is further simplified if a connection of the pump holder to the floor of the surge chamber is configured as a positive connection.

The ejector may be configured in one piece with the pump holder. However, the ejector exhibits a nozzle and a mixing tube at a distance from the nozzle which complicates the configuration of the pump holder. In accordance with another embodiment of the present invention, the pump holder may be particularly easily manufactured if the floor of the surge chamber exhibits a partial region of a mixing tube of the ejector.

In accordance with another embodiment of the invention, one half of a nozzle and the mixing tube of the ejector are respectively arranged in the surge chamber and the other halves of the nozzle and mixing tube are arranged in the pump holder. Due to this configuration, the ejector is longitudinally split and may, therefore, together with the surge chamber and the pump holder, be simply manufactured by injection casting with axial removal from the molds a particularly cost-favorable configuration.

The inventive design may be further simplified if the ejector is positively connected to the pump holder.

The ejector may, for example, exhibit a branch arranged in the region of an outlet duct leading to the internal combustion engine. Because, however, the internal combustion engine of the motor vehicle requires a higher pressure than the ejector, a branch so arranged requires a cost-intensive pressure-reducing valve arranged. The requirement for a cost-intensive pressure-reducing valve is obviated if the fuel pump is embodied as a peripheral pump or a side channel pump and if a nozzle of the ejector is connected to a branch arranged in the central region of a delivery chamber of the fuel pump. In this arrangement, the branch is arranged at a location in the fuel pump at which the pressure adjusts automatically to the specified pressure.

In a further advantageous embodiment, the ejector is supplied with fuel via its own pump stage. This additional pump stage may be arranged, in a particularly low-cost manner, in the rotor of the main pump stage in a peripheral pump or side channel pump.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
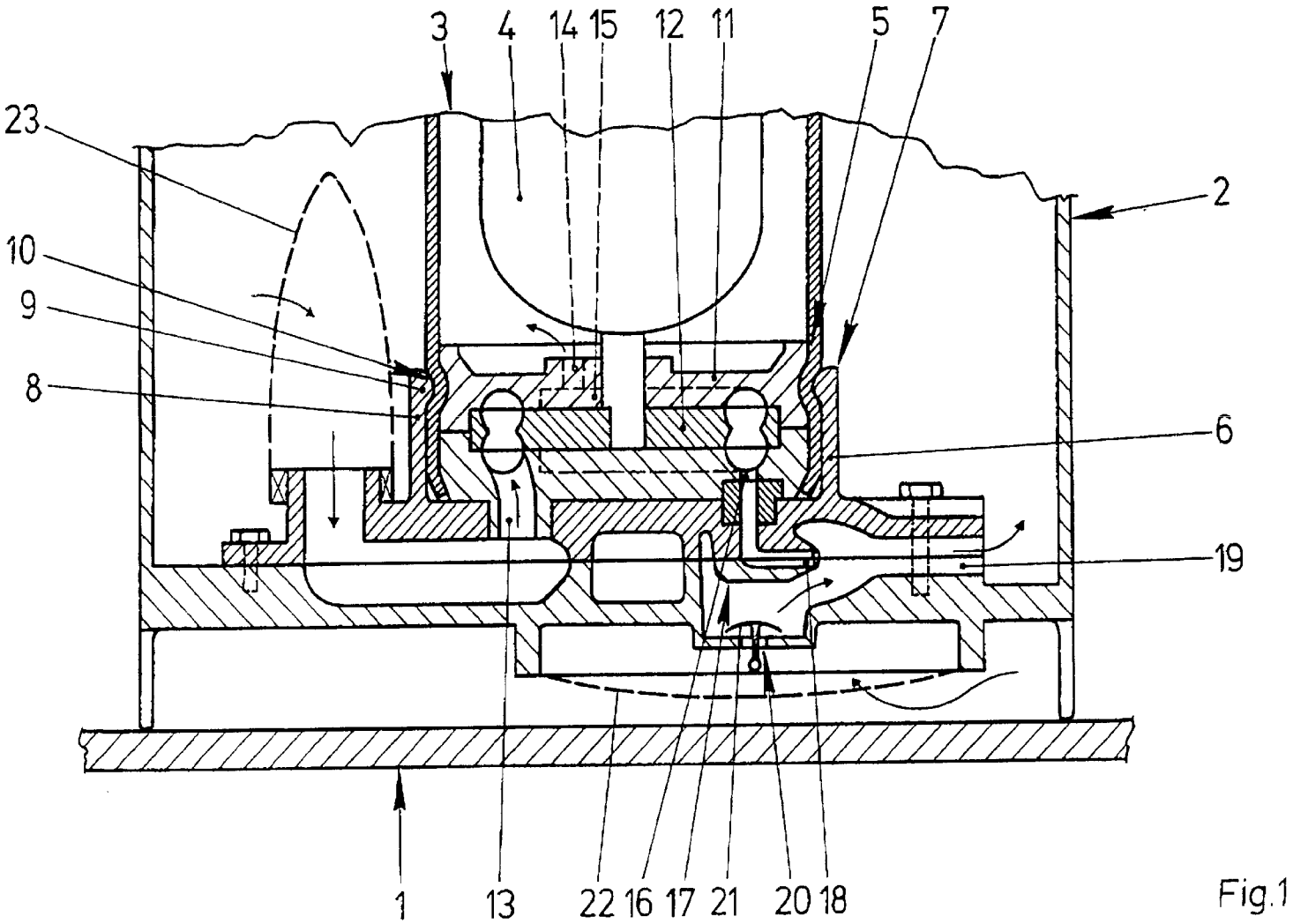
FIG. 1 is a longitudinal sectional view of a lower region of a delivery unit according to an embodiment the present invention with adjacent regions of a fuel tank.

FIG. 1 shows a surge chamber 2 arranged on a floor of a fuel tank 1 of a motor vehicle with a delivery unit 3 arranged in the surge chamber 2. The delivery unit 3 has a fuel pump 5 driven by an electric motor 4 and a pump holder 6 for fastening the fuel pump 5 in the surge chamber 2. The pump holder 6 is screwed to the floor region of the surge chamber 2 and has a snap-in connection 7 to the fuel pump 5. The snap-in connection 7 includes a rim 8 with a protrusion 9 which points radially inwards. The rim 8 stands out from the pump holder 6 and surrounds the fuel pump 5. The protrusion 9 penetrates into a depression 10 in the fuel pump 5 for holding the fuel pump. In FIG. 1, the pump holder 6 is screwed onto the floor region of the surge chamber 2.

The fuel pump 5 is embodied as a side channel pump and has a rotor 12 which rotates in a pump housing 11. The fuel pump 5 further includes a delivery chamber 15 extending from an inlet duct 13 to an outlet duct 14. A branch 16 leads from a central region of the delivery chamber 15 to an ejector 17. The ejector 17 has a nozzle 18 connected to the branch 16 and a mixing tube 19 at a distance from the nozzle 18. The nozzle 18 and the mixing tube 19 are respectively formed with one half in the surge chamber 2 and the other half in the pump holder 6. Because of this arrangement, the nozzle 18 and the mixing tube 19 may be manufactured by injection casting with axial removal from the mold. The region between the mixing tube 19 and the nozzle 18 is connected to the fuel tank 1 via an opening 20 in the floor region of the surge chamber 2. A floor valve 21 through which fuel exclusively penetrates from the fuel tank into the surge chamber 2 is arranged in the opening 20. In addition, a fuel filter 22 is arranged before the opening 20. For fitting or removing the delivery unit 3 from the surge chamber 2, the fuel pump 5 may be withdrawn from the pump holder 6. Alternatively, the pump holder 6 may be unscrewed and removed from the surge chamber 2 together with the fuel pump 5.

The fuel pump 5 suctions the fuel from the surge chamber 2 through the fine filter 23 and delivers the fuel via the outlet duct 15 to an internal combustion engine (not shown) of the motor vehicle. During the pumping process, a part of the quantity of the fuel being pumped reaches the nozzle 18 of the ejector 17 via the branch 16. The ejector 17 suctions fuel out of the fuel tank 1 via the floor valve 21 and delivers the fuel from the fuel tank to the surge chamber 2. For clarification, the fuel flows are designated by arrows in the drawing. This arrangement ensures that fuel is always available in the surge chamber 2.

Figure 2:
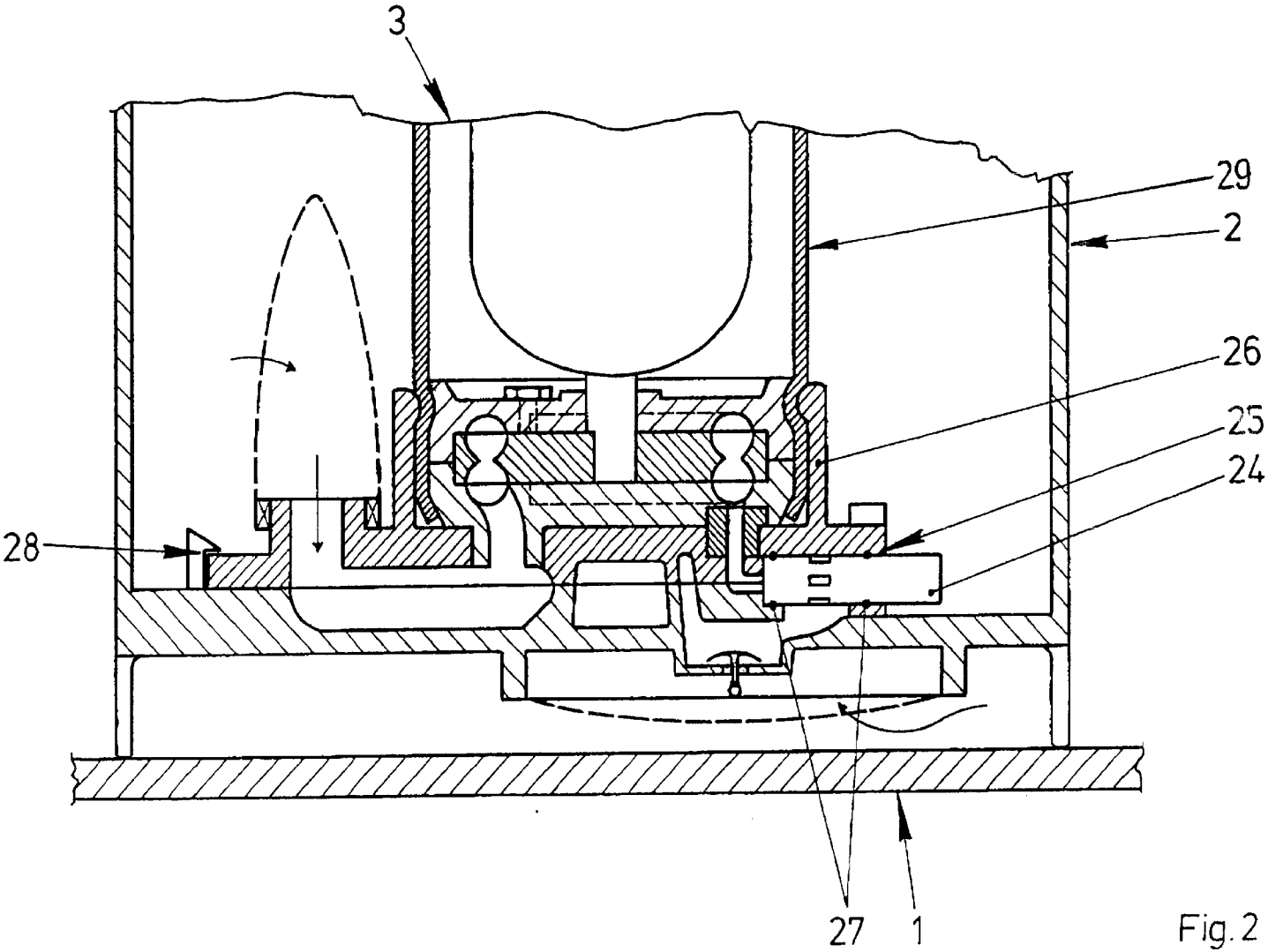
FIG. 2 is a longitudinal sectional view of a further embodiment of the delivery unit according to the present invention.

FIG. 2 shows a further embodiment of a delivery unit 29 arranged in the surge chamber 2. This delivery unit 29 mainly differs from that of FIG. 1 in that an ejector 24 is inserted as a separate component in an acceptance feature 25 of a pump holder 26. The pump holder 26 further includes sealing rings 27 for holding the ejector 24. In addition, the pump holder 26 is fastened to the floor region of the surge chamber 2 by means of a snap-in connection 28.

Figure 3A:
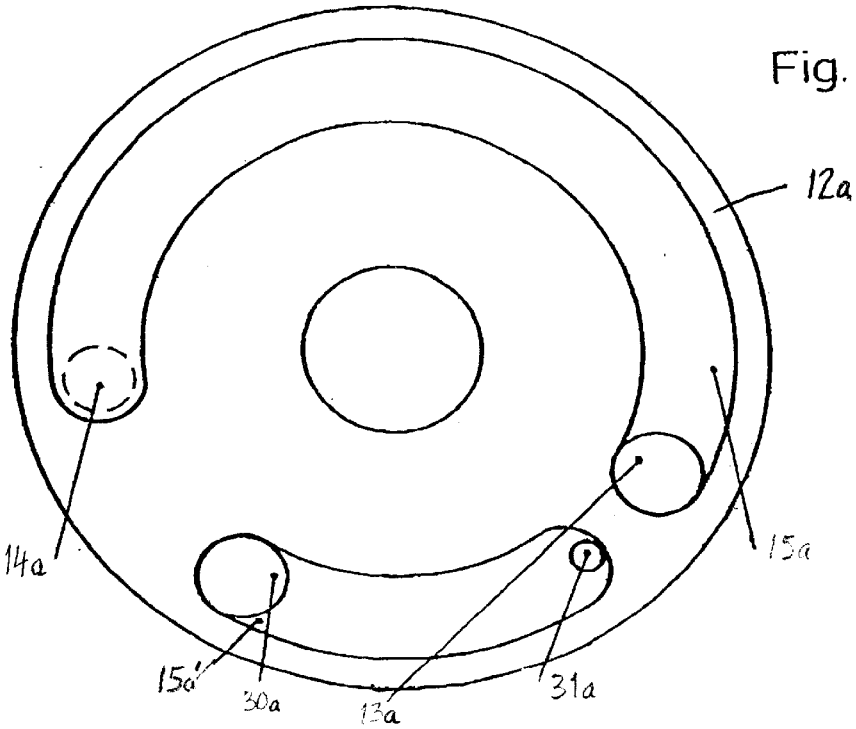
FIGS. 3*a* and 3*b* is a sectional view of the delivery unit showing two different embodiments of delivery chambers according to the present invention.

FIG. 3*a* shows the configuration of delivery ducts 15*a,* 15*a*' relative to a rotor 12*a* according to an embodiment of the present invention which may be used with the delivery unit 3 in FIG. 1 or delivery unit 29 in FIG. 2. The two delivery ducts 15*a,* 15*a*' are arranged one behind the other in a circumferential direction of the rotor 12*a*. The respectively longer delivery duct 15*a* has an inlet duct 13*a* connected to the surge chamber 2 and an outlet duct 14*a* connected to the internal combustion engine of the motor vehicle. The respectively shorter delivery duct 15*a*' has an inlet 30*a* connected to the surge chamber 2 and an outlet 31*a* connected to the nozzle of the ejector 17, 24 (FIGS. 1 and 2).

Figure 3B:
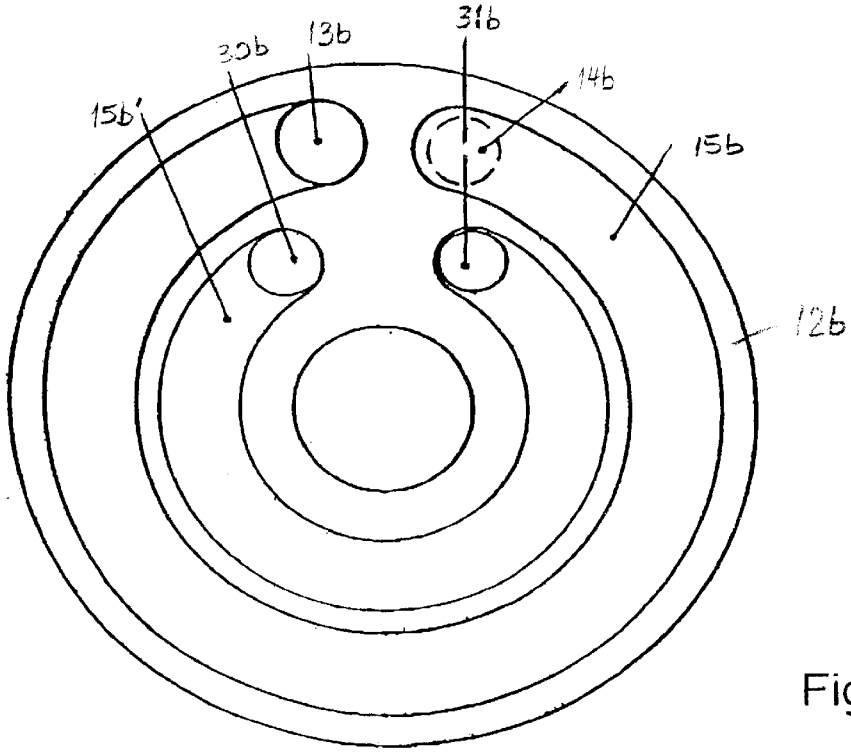

FIG. 3*b* shows a configuration of delivery ducts 15*b,* 15*b*' according to an embodiment of the present invention that are arranged concentrically to one another. The respectively longer delivery duct 15*b* has an inlet duct 13*b* connected to the surge chamber 2 and an outlet duct 14*b* connected to the internal combustion engine of the motor vehicle. The respectively shorter delivery duct 15*b*' has an inlet 30*b* connected to the surge chamber 2 and an outlet 31*b* connected to the nozzle of the ejector 17, 24 (see FIGS. 1 and 2).

In both FIGS. 3*a* and 3*b,* the two delivery ducts 15*a,* 15*a*' and 15*b,* 15*b*' are fluidically separated in that the fluid in one duct 15*a,* 15*b* does not mix with the fluid in the other duct 15*a*', 15*b*'.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A delivery unit arranged in a surge chamber of a fuel tank of a motor vehicle, said delivery unit comprising a plurality of components including:

a surge chamber arrangeable in the fuel tank of a motor vehicle and comprising a floor;

a fuel pump provided for the delivery of fuel from said surge chamber to an internal combustion engine of the motor vehicle;

an ejector connected to the fuel pump for the delivering fuel from the fuel tank to the surge chamber and comprising a nozzle and a mixing tube; and a pump holder arranged for releasably holding said fuel pump in said surge chamber, wherein each of said nozzle and said mixing tube of said ejector includes a first portion defined by said floor of said surge chamber and a remaining portion defined by at least another one of said plurality of components.

2. The delivery unit of claim 1, wherein said pump holder is fastened onto said floor of said surge chamber, and said pump holder comprises a snap-in connection for connection of said fuel pump to said pump holder.

3. The delivery unit of claim 2, wherein said pump holder comprises a peripheral rim having a free end extending upward from said floor of said surge chamber and surrounding a lower region of said fuel pump, and wherein said snap-in connection comprises a protrusion extending radially inward on said free end of said rim.

4. The delivery unit of claim 2, wherein said pump holder is connected to said floor of said surge chamber via a positive connection.

5. The delivery unit of claim 1, wherein said remaining portion of each of said nozzle and said mixing tube are defined by said pump holder.

6. The delivery unit of claim 1, wherein said ejector is positively connected to said pump holder.

7. The delivery unit of claim 1, wherein said ejector comprises a nozzle and a mixing tube and said fuel pump comprises one of a peripheral pump and a side channel pump, said delivery unit further comprising a branch connecting said nozzle to said fuel pump, and wherein said fuel pump further comprises a delivery chamber for delivery of fuel to the internal combustion engine of the motor vehicle having a central region connected to said branch.

8. The delivery unit of claim 1, wherein said fuel pump comprises one of a peripheral pump and side channel pump having a first delivery channel having an inlet and an outlet and a second delivery channel having an inlet and an outlet, and wherein said ejector comprises a nozzle connected to the outlet of said second delivery chamber, said first and second delivery chambers being fluidically separated.

* * * * *